US009392846B2

(12) United States Patent
Shirai

(10) Patent No.: US 9,392,846 B2
(45) Date of Patent: Jul. 19, 2016

(54) SLIDE ADJUSTER

(71) Applicant: BUILMATEL CO., LTD., Chuo-ku, Tokyo (JP)

(72) Inventor: Syoji Shirai, Tokyo (JP)

(73) Assignee: BUILMATEL CO.,LTD., Tokyo (JP)

( * ) Notice: Subject to any disclaimer, the term of this patent is extended or adjusted under 35 U.S.C. 154(b) by 0 days.

(21) Appl. No.: 14/440,169

(22) PCT Filed: Aug. 26, 2013

(86) PCT No.: PCT/JP2013/072641
§ 371 (c)(1),
(2) Date: May 1, 2015

(87) PCT Pub. No.: WO2014/073255
PCT Pub. Date: May 15, 2014

(65) Prior Publication Data

US 2015/0289600 A1 Oct. 15, 2015

(30) Foreign Application Priority Data

Nov. 8, 2012 (JP) ..... 2012-245987
Dec. 27, 2012 (JP) ..... 2012-285479
Jul. 31, 2013 (JP) ..... 2013-159549

(51) Int. Cl.
*A44B 11/24* (2006.01)
*A44B 99/00* (2010.01)
(Continued)

(52) U.S. Cl.
CPC ..... *A44B 11/24* (2013.01); *A41F 1/008* (2013.01); *A44B 99/00* (2013.01); *A44C 5/2071* (2013.01)

(58) Field of Classification Search
CPC ..... Y10S 24/48; Y10S 24/45623; Y10S 24/45677; Y10S 24/45639; Y10S 24/45702; A44B 11/2515; A44B 11/2519; A44B 11/253; A44C 5/2052; A44C 5/2066; A41F 1/008
See application file for complete search history.

(56) References Cited

U.S. PATENT DOCUMENTS 809,465 A * 1/1906 Roy ..... A44B 11/00 24/DIG. 48
1,627,776 A * 5/1927 Haumerson ..... B60C 27/10 24/DIG. 48

(Continued)

FOREIGN PATENT DOCUMENTS

CN 101522067 A 9/2009
DE 1231468 B 12/1966

(Continued)

OTHER PUBLICATIONS

Extended European Search Report dated Sep. 22, 2015, issued in counterpart European Application No. 13853794.9.

(Continued)

*Primary Examiner* — Robert J Sandy
(74) *Attorney, Agent, or Firm* — Holtz, Holtz & Volek PC

(57) ABSTRACT

A slide adjuster includes: an operating piece having an engagement pawl on one end thereof is provided to the inner side of a main body of a buckle, the engagement pawl of the buckle being capable of engaging with saw-toothed engagement grooves formed along an edge of a band; the operating piece is made pivotable by being supported by a connection shaft at the midpoint thereof; when the band is passed through the insertion space of the buckle, the band moves forward while the edge of the band contacts the engagement pawl of the operating piece and presses said one end of the operating piece upward; and the operating piece returns to the initial state thereof in reaction to contacting a control piece.

9 Claims, 9 Drawing Sheets

(51) Int. Cl.

| | |
|---|---|
| ***A41F 1/00*** | (2006.01) |
| *A44C 5/20* | (2006.01) |

(56) References Cited

U.S. PATENT DOCUMENTS

| | | | | |
|---|---|---|---|---|
| 1,910,891 | A | 5/1933 | Freysinger | |
| 1,910,892 | A * | 5/1933 | Freysinger | A41F 1/00 24/DIG. 48 |
| 4,577,375 | A * | 3/1986 | Beaussant | A62B 18/084 24/DIG. 48 |
| 5,774,953 | A | 7/1998 | Mao | |
| 6,457,210 | B1 | 10/2002 | Shirai et al. | |
| 8,146,211 | B2 | 4/2012 | Shirai et al. | |
| 2010/0175232 | A1 | 7/2010 | Shirai et al. | |
| 2010/0281661 | A1 | 11/2010 | Harada et al. | |
| 2012/0180197 | A1 | 7/2012 | Cosky | |
| 2012/0233743 | A1 | 9/2012 | Park | |
| 2015/0013115 | A1 | 1/2015 | Shirai | |

FOREIGN PATENT DOCUMENTS

| | | | |
|---|---|---|---|
| JP | 2000135103 | A | 5/2000 |
| JP | 2001204518 | A | 7/2001 |
| JP | 2004135724 | A | 5/2004 |
| JP | 3982955 | B2 | 9/2007 |
| JP | 4005109 | B1 | 11/2007 |
| JP | 4368023 | B2 | 11/2009 |
| JP | 2010220795 | A | 10/2010 |
| JP | 5049399 | B1 | 10/2012 |
| JP | 2012249999 | A | 12/2012 |
| JP | 5192607 | B1 | 5/2013 |
| WO | 0068742 | A2 | 11/2000 |
| WO | 2011034333 | A2 | 3/2011 |
| WO | 2012165591 | A1 | 12/2012 |

OTHER PUBLICATIONS

Chinese Office Action (and English translation thereof) dated Nov. 26, 2015, issued in Chinese Application No. 201380058095.6.

International Search Report (ISR) dated Nov. 12, 2013 issued in International Application No. PCT/JP2013/072641.

Non-Final Office Action dated Apr. 3, 2015, issued in U.S. Appl. No. 14/377,482.

Extended European Search Report dated Sep. 7, 2015, issued in counterpart European Application No. 13853808.7.

Related U.S. Appl. No. 14/377,482; First Named Inventor: Syoji Shirai; Title: "Buckle"; filed, Aug. 7, 2014.

Non-Final Office Action dated Feb. 2, 2016, issued in related U.S. Appl. No. 14/377,482.

International Search Report dated Oct. 15, 2013 issued in International Application No. PCT/JP2013/071435.

Non-Final Office Action dated Feb. 1, 2016, issued in U.S. Appl. No. 14/377,482.

Office Action dated May 17, 2016, issued in related U.S. Appl. No. 14/377,482.

* cited by examiner

SLIDE ADJUSTER

TECHNICAL FIELD

The present invention relates to a slide adjuster for sliding a band relative to a buckle to adjust the length of the band and fix the band, and particularly to a slide adjuster used for a wristwatch, a smartphone, a portable music player, a shoe or a hat.

BACKGROUND ART

Conventionally, there is known a buckle with a hook elastically engaging with engagement grooves provided on a band (or a belt), in which the locked state can be released at any time.

In Japanese Patent No. 4368023 (Patent Document 1), the inventors propose, as a band with a buckle having a surface as flat as possible by thinning the thickness of the buckle, a band with a buckle connected annularly while one end of the band is inserted to a tubular buckle provided on the other end of the band to adjust the circumferential length of the band, in which a saw-toothed engagement recessed part is formed along an edge of the one end, and an engagement projecting part is provided in an insertion space of the buckle, so that the one end of the band can freely move forward through the insertion space but cannot retreat, and a guide for restricting swing of the band within a plane surface orthogonal to the forward direction of the band is provided at least at a position close to the engagement projecting part of the insertion space.

The above-described band with a buckle is adequate as a band for wearing a precision device such as a wristwatch around an arm because the buckle thickness is extremely thin. However, the engagement projecting part is elastically engaged with the engagement recessed part, similarly to the conventional buckle, which has caused a problem that the elasticity is deteriorated with time and the engagement strength is reduced.

Moreover, in Japanese Patent No. 5049399 (Patent Document 2), the inventors propose, as an invention related to a synthetic resin buckle particularly for a product requiring comparatively strong fastening force such as an athletic shoe, sports shoe, a snowboard boot, and a protector locking belt, a buckle allowing a band to freely approach the buckle but not allowing the band to retreat in a locked state where an engagement pawl of the buckle is engaged with a saw-toothed engagement groove formed on the outer surface of the band, the buckle including a buckle body that has a bottom plate and a top frame facing each other, and both side plates connecting the bottom plate and the top frame, with the interior of the buckle body serving as an insertion space for the band, and an operation plate horizontally installed inside the top frame and having, at the lower surface of one end, the engagement pawl that can be engaged with the engagement groove of the band, while forming the other end as a pressing part for releasing the engagement, the operation plate being supported by a connection shaft for connecting both side plates at a midpoint between the engagement pawl and the pressing part such that the operation plate is pivotable around the midpoint serving as a fulcrum, in which a sliding piece horizontally movable on the upper part of the operating plate is installed at the buckle body, and pivot of the operation plate is restricted in a state where the sliding piece has moved to one end side of the operation plate, while the lower surface of the sliding piece is in contact with an upper surface of the pressing part in a state where the sliding piece has moved to the pressing part side.

This buckle has a locking mechanism, thus preventing the release of engagement even against pressing force acting directly on the pressing part. However, the engagement pawl is elastically engaged with the engagement groove, similarly to the conventional buckle, which has caused a problem that, when the released state continues for a long time by the action of the sliding piece, the elasticity is deteriorated with time due to a creep phenomenon (characteristics in which synthetic resin is deformed slowly when strong pressure is applied thereon for a long time) and the engagement strength between the band and the buckle is reduced. Moreover, when the strength of the connection shaft is increased using hard material such as metal or resin not having elasticity, it is necessary to provide a separate component such as a coil spring. When such a separate component is provided, the buckle structure becomes complicated, and thus it has been difficult to produce a buckle that is light, small, and easy to produce.

Patent Document 1: Japanese Patent No. 4368023

Patent Document 2: Japanese Patent No. 5049399

DISCLOSURE OF THE INVENTION

Problems to be Solved by the Invention

The present invention aims at providing a slide adjuster including a band and a buckle that is capable of preventing reduction of engagement strength between the band and the buckle with time and is thin in buckle thickness, light and easy to produce. Moreover, the present invention provides a slide adjuster including a band and a buckle in which an operating piece is fixed at a certain position even when a material such as metal or resin not having elasticity is used for a connection shaft.

Means for Solving the Problems

A slide adjuster of the present invention is a slide adjuster including a band and a buckle, the slide adjuster enabling an engagement pawl of the buckle to engage with saw-toothed engagement grooves formed along an edge of the band, in which the buckle includes a buckle body that has a bottom plate and a top plate facing each other and side plates connecting the bottom plate and the top plate, with an interior of the buckle body serving as an insertion space, and an operating piece that is provided inside the buckle body and has, on one end of the operating piece, the engagement pawl capable of engaging with the engagement groove of the band, and the operating piece is supported by a connection shaft connecting the bottom plate and/or the top plate at a midpoint such that the operating piece is pivotable around the midpoint as a fulcrum, and a control piece that controls pivot of the operating piece is provided on the buckle body, and when the band is passed through the insertion space of the buckle while the engagement pawl is engaged with the engagement groove of the band to be locked, the band moves forward while the edge of the band makes contact with the engagement pawl of the operating piece and presses the one end of the operating piece upward, and the operating piece returns to an initial state in reaction to making contact with the control piece, so that the band can freely approach the buckle but cannot retreat.

It is preferable that the control piece can move in the vicinity of the operating piece and the movement of the control piece can release the engagement between the band and the buckle.

It is preferable that the control piece can move in the vicinity of the operating piece and the movement of the control piece can lock the engagement between the band and the buckle.

It is preferable that the engagement grooves are formed symmetrically on facing edges of the band.

It is preferable that a stopper is provided on a tip of the band and a belt for extending the band is stored in the band.

It is preferable to provide magnets on at least the tip of the band and a bottom plate of the buckle.

It is preferable to provide, on an outer surface of the band, a fastening portion allowing the buckle and the band to be drawn close by the fingertips of one hand.

It is preferable to insert metal to portions of engagement grooves of the buckle with which the engagement pawl is brought into contact.

It is preferable to provide a case storing a precision device on the buckle.

The present invention is a slide adjuster including a band and a buckle, the slide adjuster enabling an engagement pawl of the buckle to engage with saw-toothed engagement grooves formed on an outer surface of the band, in which the buckle includes a buckle body that has a bottom plate and a top plate facing each other and side plates connecting the bottom plate and the top plate, with an interior of the buckle body serving as an insertion space, and an operating piece that is provided inside the buckle body and has, on one end of the operating piece, the engagement pawl capable of engaging with the engagement groove of the band, and the operating piece is supported by a connection shaft connecting the interior of the buckle at a midpoint such that the operating piece is pivotable around the midpoint as a fulcrum, and a control piece that controls pivot of the operating piece is provided on the buckle body, one end side of the operating piece is elastically brought into contact with the control piece while other end side of the operating piece is brought into contact with the control piece, and when the band is passed through the insertion space of the buckle while the engagement pawl is engaged with the engagement groove of the band to be locked, the band moves forward while the band makes contact with the engagement pawl of the operating piece and presses the one end of the operating piece upward, and the one end of the operating piece returns to an initial state in reaction to pressure contact with the control piece, so that the band can freely approach the buckle but cannot retreat.

It is preferable to provide an elastic portion on one end of the control piece so that the one end side of the operating piece is elastically brought into contact with the control piece.

It is preferable to provide an elastic portion on one end of the operating piece so that the one end side of the operating piece is elastically brought into contact with the control piece.

It is preferable to form a recessed part on a portion of the control piece with which the other end of the operating piece is brought into contact.

It is preferable that the control piece can move in the vicinity of the operating piece and the movement of the control piece can release the engagement between the band and the buckle.

Effects of the Invention

In the slide adjuster of the present invention, when the band is passed through the insertion space of the buckle, the control piece controls pivot of the operating piece so that the band can freely approach the buckle but cannot retreat. Therefore, it is possible to provide a buckle that is capable of preventing reduction of engagement strength between the band and the buckle with time and is light, small, and easy to produce without requiring a separate component such as a coil spring. Moreover, according to the slide adjuster in which engagement can be released by the control piece moving in the vicinity of the operating piece, the operation of pulling out the band can be performed easily with one hand.

According to the slide adjuster in which the one end side of the operating piece is elastically brought into contact with the control piece and the other end of the operating piece is brought into contact with the control piece, the operating piece is fixed at a certain position even when a material such as metal or resin not having elasticity is used for the connection shaft.

PREFERRED MODE FOR CARRYING OUT THE INVENTION

Embodiments of a buckle according to the present invention will be described below based on the enclosed drawings.

Figure 1A:
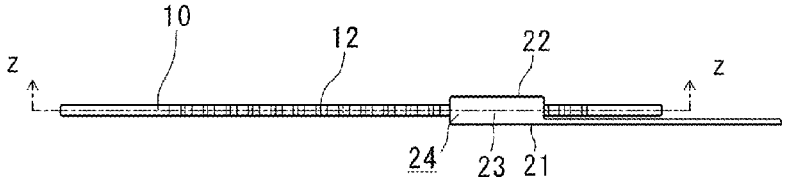
FIG. 1A is a side view of a slide adjuster of the present invention.
Figure 1B:
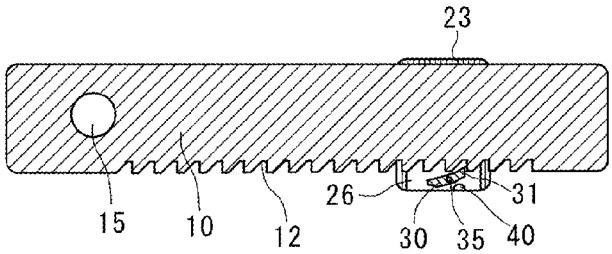
FIG. 1B to 1D are section views thereof taken along the line z-z of FIG. 1A.
Figure 1C:
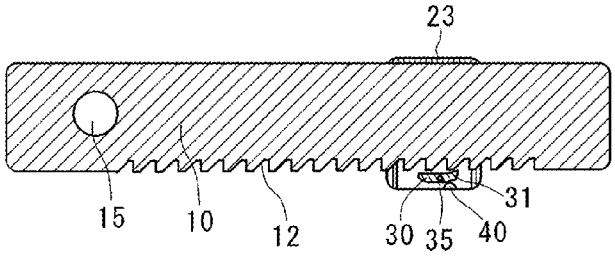
Figure 1D:
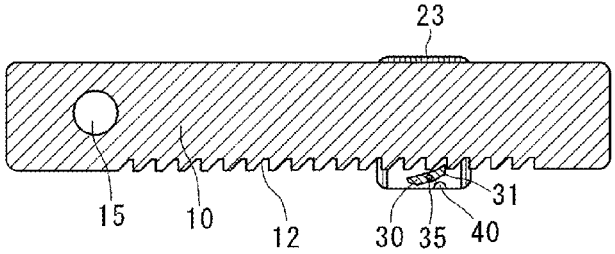

FIGS. 1A to 1D illustrate a slide adjuster including a band and a buckle according to the present invention. FIG. 1A is a side view thereof, and FIGS. 1B to 1D are section views taken along the z-z line of FIG. 1A.

In such drawings, along an edge of a band having a required length, width, and thickness, saw-toothed engagement grooves are formed from the tip (portion close to the buckle) to the other end, and a fastening portion 15 having a size allowing a fingertip to be hooked is provided beyond the engagement grooves 12 at the other end of the band. The length, width, and thickness of the band 10 are appropriately determined depending on a use of the slide adjuster.

The main body of the buckle 20 is constituted by a flat and tubular buckle body 24 including a bottom plate 21, a top plate 22 facing the bottom plate 21, side plates 23, 23 connecting the bottom plate 21 and the top plate 22. The buckle body 24 is open as an insertion port in a sliding direction of the band 10, and the interior of the buckle body 24 serves as insertion space 26 of the band 10. In the embodiment, the length of the bottom plate 21 in the longitudinal direction (sliding direction of the band 10) is made longer than the length of the top plate 22 in the longitudinal direction, thereby making it easier to attach the buckle 20 on a connected body (that is, a watch, for example), and enabling the band 10 to be inserted smoothly. Moreover, the same effect can be obtained by making the length of the top plate 22 in the longitudinal direction longer than the length of the bottom plate 21 in the longitudinal direction.

In the inner side of the buckle body 24, an operating piece 30 having a size allowing the operating piece 30 to be stored in the buckle body 24 is provided. An engagement pawl 31 that can engage with the engagement grooves 12 of the band 10 is formed to project on one end of the operating piece 30.

A connection shaft 35 is formed at the midpoint of the operating piece 30 in the longitudinal direction and supported by the bottom plate 21 and/or the top plate 22. As a result, the operating piece 30 is made pivotable with the midpoint as a fulcrum.

In the embodiment, the cross section of the connection shaft 35 is circular. However, the section may be an oval shape. It is preferable that the connection shaft 35 is made as thin as possible so as to support the operating piece 30 to be pivotable and secure smooth operability. However, it is sufficient that the connection shaft 35 has a form and a size not allowing damage by repeated pivoting.

In the present invention, the material of the connection shaft is not particularly limited, and synthetic resin having elasticity or a hard material such as metal or resin not having elasticity may be used. When such hard material is used, the strength of the connection shaft itself is increased, and thus the engagement strength between the band 10 and the buckle 20 is enhanced.

A control piece 40 controlling pivot of the operating piece 30 is provided in the buckle body 14. The form of the control piece 40 is not particularly limited as long as the control piece 40 exerts a function of controlling pivot of the operating piece 20, as described later.

Next, the operation of the slide adjuster will be described. FIG. 1B illustrates the state in which the band 10 is inserted in the insertion space 26 of the buckle 20 and the engagement pawl 31 of the buckle 20 is engaged with the engagement groove 12 formed along the edge of the band 10. The engagement groove 12 has a saw-toothed section in the sliding direction, that is, includes a tapering surface deepening gradually toward the forward direction of the band 10 and a wall surface rising substantially perpendicular from the deepest position of the tapering surface.

The cut depth of the engagement groove 12 (length along the width direction of the band 10) is preferably approximately 2 to 10 mm. The space between adjacent engagement grooves 12, 12 is preferably approximately 3 to 7 mm.

In the embodiment, the engagement grooves 12 are completely cut out in the thickness direction of the band 10.

Figure 2A:
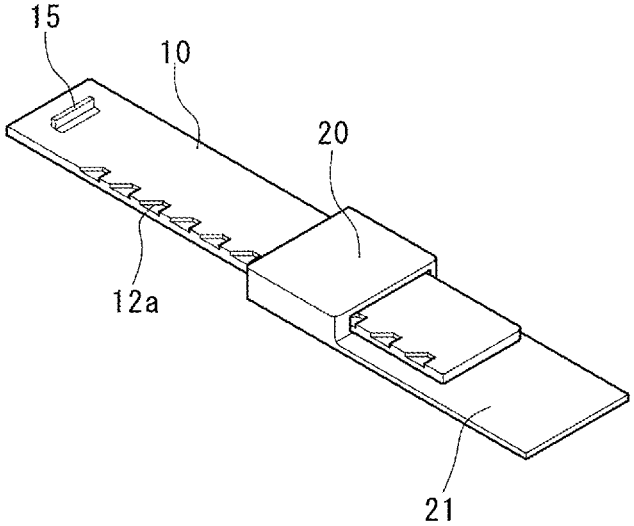
FIG. 2A, 2B are perspective views of the slide adjuster illustrating a modification of engagement grooves.
Figure 2B:
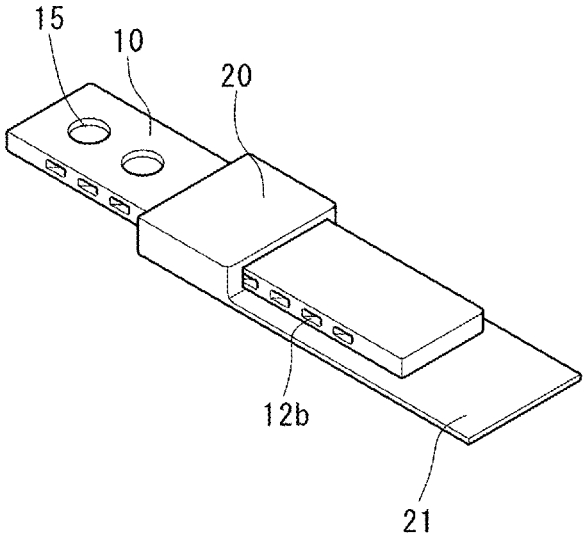

However, if the thickness of the band 10 is sufficient, it is possible to arrange engagement grooves 12*a* cut to the middle in the thickness direction of the band 10, as illustrated in FIG. 2A. Furthermore, as illustrated in FIG. 2B, it is also possible to arrange engagement grooves 12*b* at an intermediate part in the thickness direction of the band 10, that is, form the saw-toothed engagement grooves 12*b* to retreat in the band and arrange the edge of the band to be linear. In this case, the band width in the longitudinal direction of the band 10 is secured to be constant, which prevents the band 10 from being buckled easily. Moreover, the saw-toothed cut form is not exhibited externally, which increases the degree of freedom of design.

In FIG. 1B, when the band 10 is passed through the insertion space 26 from the insertion port on the left side of the buckle, the band 10 moves forward while the edge of the band 10 makes contact with the engagement pawl 31 of the operating piece 30 and presses one end of the operating piece 30 upward, and the engagement pawl 31 is removed from the engagement groove 12 (see FIG. 1C). When the band 10 is passed through further, the operating piece 30 returns to the initial position in reaction to contacting the control piece 40, and the engagement pawl 31 engages with the adjacent engagement groove 12 (see FIG. 1D). The band 10 is passed through the insertion space 26 while repeating this action, whereby the approach and separation position of the band 10 relative to the buckle 20 is adjusted. That is, in this state, the engagement pawl 31 is engaged with the given engagement groove 12 to be locked, so that the band 10 can freely move forward through the buckle 20 but cannot retreat.

In the present invention, the control piece 40 exerts a function of a spring energizing one end of the operating piece 30 toward the side of the engagement groove 12. Thus, the connection shaft 35 itself does not need to have a function of a spring. Therefore, with the use of material such as metal or resin not having elasticity for the connection shaft 35, the connection shaft 35 is not damaged when strong force acts in the direction separating the band 10 from the buckle 20, even if the connection shaft 35 is made thin to downsize the buckle. Moreover, the engagement strength is not reduced due to reduction of elasticity of the connection shaft 35 with time that is caused by a creep phenomenon (characteristics in which synthetic resin is slowly deformed when strong pressure is applied thereon for a long time).

Furthermore, there is no need to provide a coil spring or the like as a separate component, which minimizes the number of components and further simplifies the structure of the buckle 20.

The size of the insertion space 26 of the buckle 20 may be arbitrary as long as the band 10 can be smoothly inserted thereto. However, it is preferable to provide, at a position close to the engagement pawl 31, a guide for restricting swing of the band 10 within a plane surface orthogonal to the forward direction of the band 10. When the guide is provided, the band 10 can be inserted smoothly, and the engagement pawl 31 of the buckle 20 can accurately engage with the engagement groove 12 of the band 10, thus preventing problems such as damage of the operating piece 30 near the engagement pawl 31 or buckling of the band 10 near the engagement pawl 31. When the guide is provided in the insertion space 26 of the buckle 20, it is preferable to form the guide by partially narrowing an inner wall of the buckle 20 at a position adjacent to the engagement pawl 31 in the insertion space 26, and there is no need to provide a guide member as a body separate from the buckle 20. It is preferable to make the longitudinal and lateral lengths of the guide equal to the width and thickness of the band 10 as much as possible so that the guide is brought into contact with the periphery of the band 10. The length of the guide in the forward direction of the band is preferably the same as the above-described space between the adjacent engagement grooves 12, 12 or longer than such space.

The fastening portion 15 of the band 10 is not necessarily provided. However, with the fastening portion 15, the band 10 can be easily passed through the insertion space 26 of the buckle 20. In the embodiment, the fastening portion 15 is formed as a through-hole passing through the band 10 in the thickness direction thereof. However, the form of the fastening portion 15 is not particularly limited as long as the fastening portion 15 has a size and form allowing a fingertip to be hooked. When the fastening portion 15 has a projecting form, it is preferable to form the projection to be freely erect or laid flat so as to not project on the surface of the band 10 unless operated (see FIG. 2A). Moreover, the number of positions where the fastening portions 15 are provided is not limited to one, and a plurality of fastening portions 15 may be provided with space between each other (see FIG. 2B).

Figure 3A:
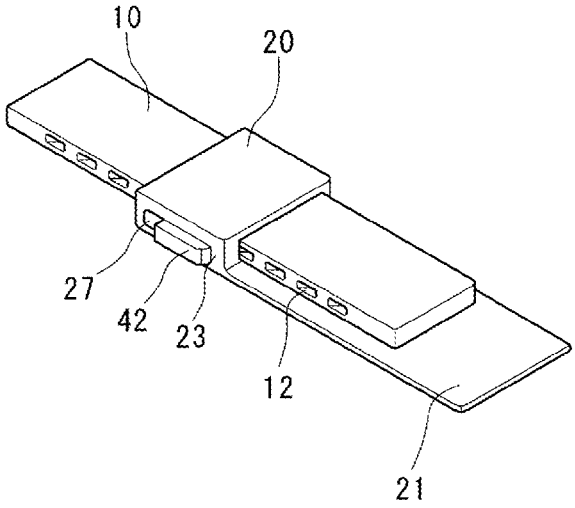
FIG. 3A is a perspective view illustrating another embodiment of the slide adjuster.
Figure 3B:
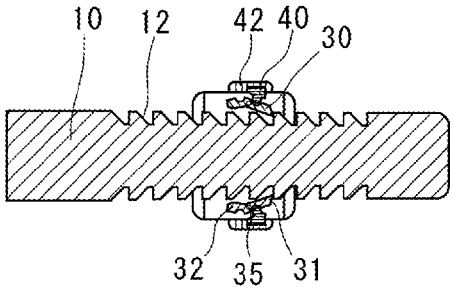
FIGS. 3B to 3D are plan views of the slide adjuster cut on a horizontal surface parallel to a band.
Figure 3C:
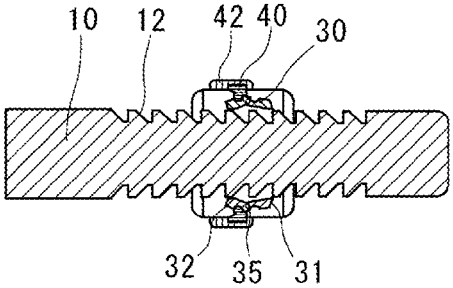

Subsequently, another embodiment of the slide adjuster will be described with reference to FIGS. 3A to 3D. FIG. 3A is a perspective view of a slide adjuster, and FIGS. 3B, 3C are plan views of the slide adjuster of FIG. 3A cut on a horizontal surface parallel to the band. Here, the components same as those of the above-described embodiment are represented with same symbols, and the explanation thereof will be omitted.

In the embodiment, the engagement grooves 12, 12 are formed symmetrically on the edges of the band 10. Moreover, this embodiment is different from the above-described embodiment in that the control piece 40 slides in the vicinity of the operating piece 30 in the forward and backward direction of the band. The control piece 40 is formed integrally with a sliding operation portion 42 and provided on the buckle body 24. The form and size of the sliding operation portion 42 are not particularly limited as long as the sliding operation portion 42 has a size and form allowing a fingertip of a hand to be hooked. The sliding operation portion 42 is not necessarily provided in the control piece 40. However, with the sliding operation portion 42, the sliding operation of the control piece 40 can be made easier.

Moreover, on the both side plates 23, 23 of the buckle 20, sliding guides 27, 27 for guiding movement of the control piece 40 are provided (see FIG. 3A). In the embodiment, the sliding guides 27, 27 are formed as grooves on the side plates 23, 23 of the buckle 20. However, the position and form of the sliding guide 27 are not particularly limited as long as the sliding guide 27 can guide smooth movement of the control piece 40.

When the control piece 40 is slid along the sliding guides 27, 27 to the side of the other end 32 of the operating piece 30, as illustrated in FIG. 3C, the operating piece 30 rotates with the connection shaft 35 as its center. Consequently, the engagement pawl 31 positioned on the opposite side stands, and the engagement pawl 31 is removed from the engagement groove 12, thus allowing the band 10 to slide freely. When the control piece 40 is returned to the original position along the sliding guides 27, 27, the operating piece 30 returns to its initial state (see FIG. 3B).

The sliding direction of the control piece 40 is not particularly limited. Although not illustrated, it is also possible to adopt a structure in which, when the sliding piece 40 is moved to the side of the engagement pawl 31 of the operating piece 30, the side of the engagement pawl 31 of the operating piece 30 is stood up directly by the sliding piece 40, so that the engagement between the band 10 and the buckle 20 is released.

According to the embodiment, it is possible to freely pull out the band 10 from the buckle 20 with one hand by sliding the control piece 40. Therefore, the embodiment is adequate as a slide adjuster used in a watch band or the like that requires operation with one hand.

Figure 3D:
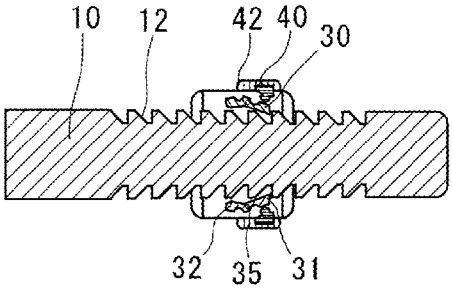

Moreover, it is also possible to lock the engagement between the band 10 and the buckle 20 by moving the control piece 40. As illustrated in FIG. 3D, when the control piece 40 is slid to the side of the engagement pawl 31 of the operating piece 30, the control piece 40 may press the engagement pawl 31 so that the engagement pawl 31 is not removed from the engagement groove 12.

In the embodiment, the control piece 40 is slid to the side of the engagement pawl 31. However, the sliding direction for locking the engagement is not particularly limited. Although not illustrated, it is possible to adopt a structure in which, when the sliding piece 40 is moved to the side of the other end 32 of the operating piece 30, the side of the other end 32 of the operating piece 30 is stood up by the sliding piece 40, and the operating piece 30 rotates with the connection shaft 35 as its center, so that the engagement pawl 31 positioned on the opposite side is engaged more firmly with the engagement groove 12, thus locking the engagement between the band 30 and the buckle 10.

Next, another embodiment of the slide adjuster will be described based on FIGS. 4A, 4B with the embodiment of a wristwatch as an example.

Figure 4A:
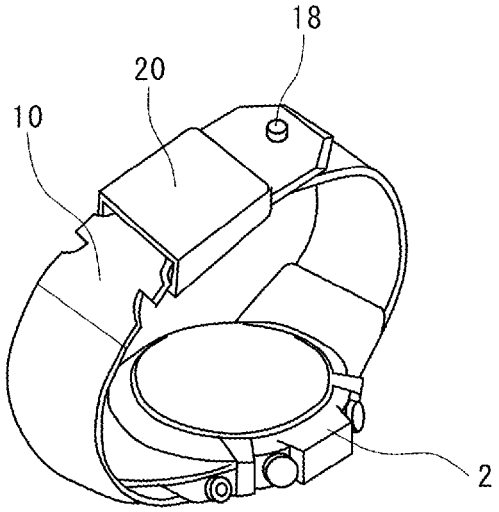
FIGS. 4A, 4B are perspective views illustrating an embodiment in which the slide adjuster is applied to a wristwatch.
Figure 4B:
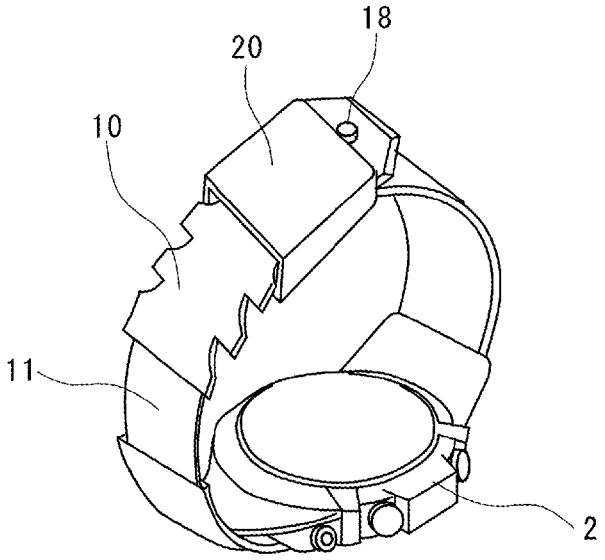

FIGS. 4A, 4B are perspective views of a wristwatch viewed from the buckle side. The band 10 and the buckle 20 are connected to both ends of a disk-shaped watch body 2, and the band 10 is locked in the buckle 20 and connected annularly. Moreover, a stopper 18 is provided on the tip of the band 10, and a belt 11 for extending a band length is stored in the band 10.

In the embodiment, when the band 10 is loosened, the stopper 18 is brought into contact with the buckle 20, thus preventing, even when the engagement is released, the band from being removed from the insertion space 26 so that the ring state of the band 10 is canceled.

When the band 10 is pulled to the direction where the band 10 is pulled out from the buckle 20 while the stopper 18 is in contact with the buckle 20, the belt 11 stored in the band 10 appears, and thus the band is extended (see FIG. 4B). Therefore, when wearing a wristwatch, a ring diameter is enlarged, as illustrated in FIG. 4B, and the band 10 is put around an arm while keeping such a state of the ring diameter. Then, the band and the buckle are drawn close with fingertips of a hand so as to adjust the ring diameter to be optimal for a wearer. When removing the wristwatch, the engagement is released and then the band is pulled, whereby the ring diameter can be enlarged enough to easily remove the wristwatch from the arm.

Figure 5A:
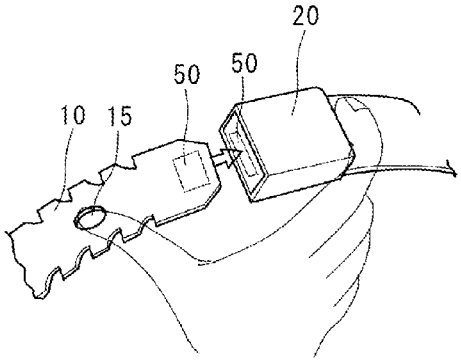
FIG. 5A is a diagram illustrating the slide adjuster in which magnets are provided in a buckle and a band.

Next, another embodiment of the slide adjuster will be described based on FIG. 5A. In the example, magnets 50, 50 are provided on the tip of the band 10 and the bottom plate 21 of the buckle 20, respectively, which makes it easier to insert the tip of the band 10 to the insertion port of the buckle 20 with one hand when wearing a wristwatch or the like. Furthermore, when the magnets 50 are appropriately provided from the tip to the other end of the band 10, and the magnets 50 are also appropriately provided on the bottom plate 21 of the buckle 20, such magnets 50 serve as guides for allowing the band 10 to be passed through the buckle 20 along the bottom plate 21.

Figure 5B:
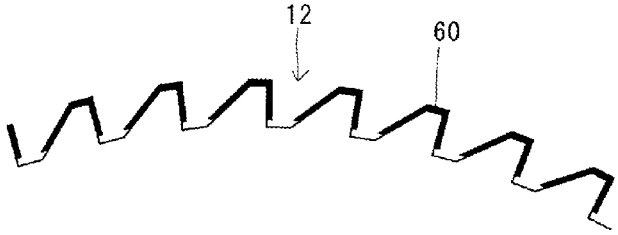
FIG. 5B is a diagram illustrating a position where metal is inserted in engagement grooves.

In the slide adjuster of the present invention, metal can be inserted into the engagement grooves 12 of the band 10. Particularly in the state where the band 10 is engaged with the buckle 20, the insertion of a superalloy to portions with which the engagement pawl 31 of the buckle 20 is brought into contact can enhance engagement strength between the band 10 and the buckle 20, and improve the appearance, thus increasing high quality feeling of the slide adjuster. When the band 10 itself needs to be bent, it is preferable to insert metal 60 at parts other than the deepest positions of the engagement grooves 12, as illustrated in FIG. 5B.

Figure 5C:
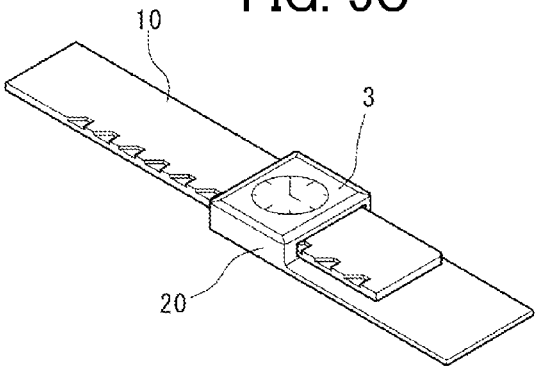
FIG. 5C is a diagram of the slide adjuster in which a case storing a precision device is provided on a buckle.

In the slide adjuster of the present invention, the thickness of the buckle 20 can be made extremely thin. Therefore, as illustrated in FIG. 5C, it is possible to provide the case 3 storing a precision device such as a wristwatch, a smartphone, and a portable music player on the buckle 20. In this way, the buckle 20 and the precision device can be formed integrally, whereby the design of the wristwatch or the like can be simpler.

Subsequently, another embodiment of the slide adjuster will be described based on FIGS. 6A, 6B, 7A, 7B, 7C.

Figure 6A:
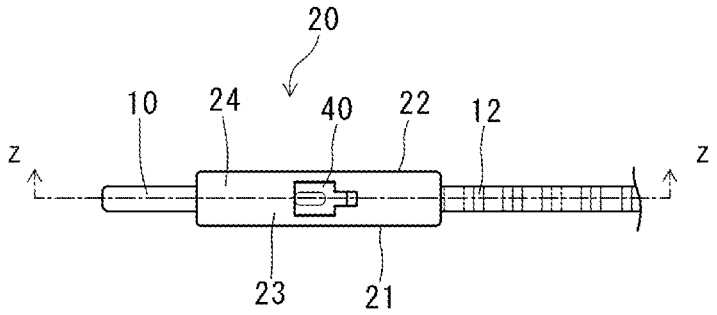
FIG. 6A is a main portion side view illustrating another embodiment of the slide adjuster.
Figure 6B:
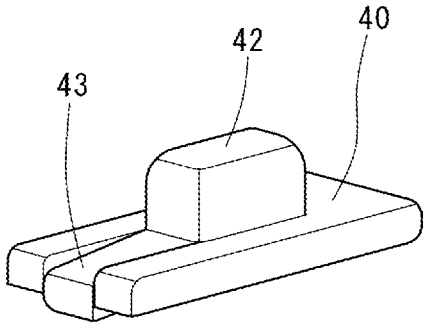
FIG. 6B is a perspective view of a control piece used for the slide adjuster.
Figure 7A:
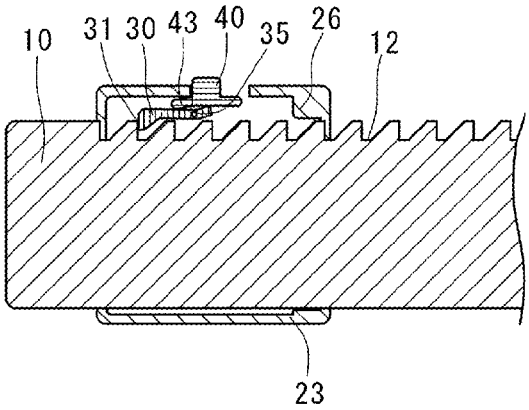
FIGS. 7A to 7C are section views taken along the z-z line of FIG. 6A.
Figure 7B:
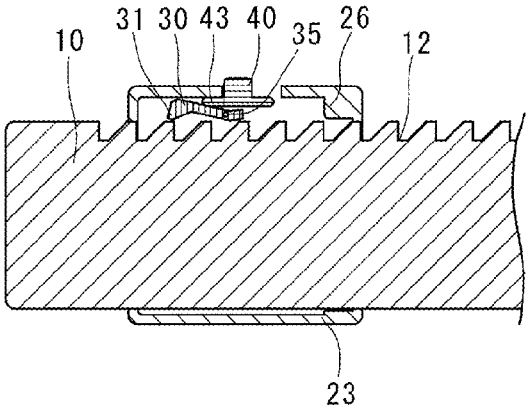
Figure 7C:
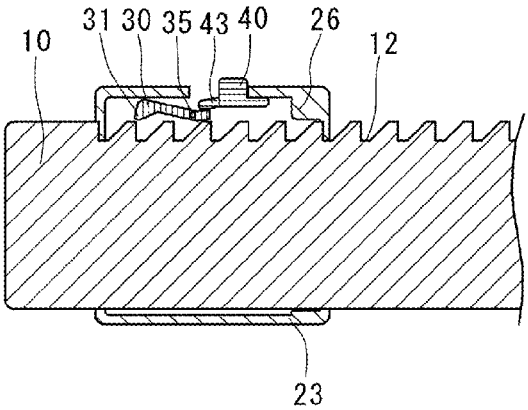

FIGS. 6A, 6B illustrate a slide adjuster including a band and a buckle according to the present invention. FIG. 6A is a side view of main portions thereof. FIG. 6B is a perspective view of the control piece. FIGS. 7A, 7B, 7C are section views taken along the z-z line of FIG. 6A.

In the embodiment, an elastic portion 43 is provided on one end of the control piece 40 by forming a slit thereon (FIG. 6B). As illustrated in FIG. 7A, one end side of the operating piece 30 is brought into contact with the elastic portion 43, and the other end side of the operating piece 30 is brought into contact with the control piece 40, whereby the operating piece 30 is fixed at a given position.

Next, the operation of the above-described slide adjuster will be described. FIG. 7A illustrates a state in which the band 10 is inserted into the insertion space 26 of the buckle 20 and the engagement pawl 31 of the buckle 20 is engaged with the engagement groove 12 formed along the edge of the band 10. In FIG. 7A, when the band 10 is passed through the insertion space 26 from the insertion port on the right side of the buckle, the band 10 moves forward while the edge of the band 10 makes contact with the engagement pawl 31 of the operating piece 30 and presses one end of the operating piece 30 upward, and the engagement pawl 31 is removed from the engagement groove 12 (see FIG. 7B). When the band 10 is passed through further, the one end of the operating piece 30 returns to the initial position thereof in reaction to pressure contact with the elastic portion 43 of the control piece 40, and the engagement pawl 31 engages with the adjacent engagement groove 12.

When the control piece 40 is slid to the side of the other end side of the operating piece 30, as illustrated in FIG. 7C, the operating piece 30 rotates with the connection shaft 35 as its center. Consequently, the engagement pawl 31 positioned on the opposite side stands, and the engagement pawl 31 is removed from the engagement groove 12, thus allowing the band 10 to slide freely. When the control piece 40 is returned to the original position, the operating piece 30 returns to its initial state.

In the embodiment, the control piece 40 is brought into contact with the one end side and the other end side of the operating piece 30, sandwiching the connection shaft 35, and thus the operating piece 30 is fixed at a given position. Moreover, the one end side of the operating piece 30 is in contact with the elastic portion 43 of the control piece 40. Therefore, the control piece 40 exerts a function of a spring energizing the one end side of the operating piece 30 toward the side of the engagement groove 12 of the band 10, and the connection shaft 35 itself does not need to have a function of a spring.

Figure 8A:
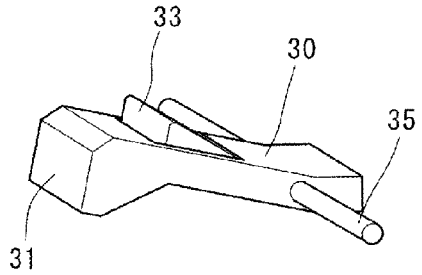
FIG. 8A is a perspective view of an operating piece in another embodiment of the slide adjuster.
Figure 8B:
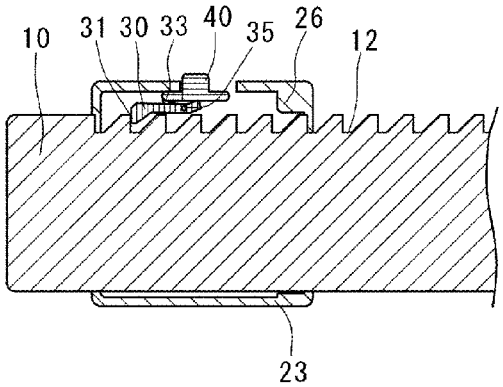
FIGS. 8B, 8C are main portion section views of the slide adjuster.
Figure 8C:
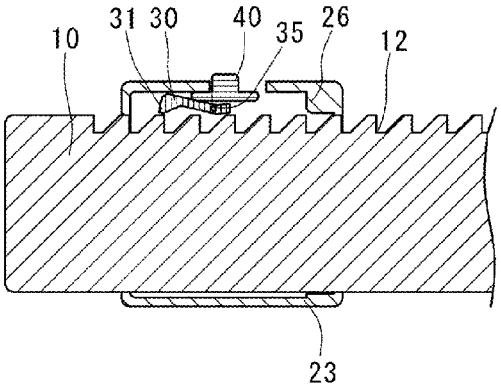

Next, another embodiment of the slide adjuster will be described with reference to FIGS. 8A, 8B, 8C. FIG. 8A is a perspective view of the operating piece 30. FIGS. 8B and 8C are plan views of the slide adjuster cut in a horizontal surface parallel to the band.

In the embodiment, an elastic portion 33 is provided on one end side of the operating piece 30 (FIG. 8A). As illustrated in FIG. 8B, the elastic portion 33 is brought into contact with the control piece 40 and the other end side of the operating piece 30 is brought into contact with the control piece 40, whereby the operating piece 30 is fixed at a given position. The elastic member 33 provided on one end side of the operating piece 30 is not particularly limited, and may be a plate spring, a coil spring, or a member using elasticity of synthetic resin.

In FIG. 8B, when the band 10 is passed through the insertion space 26 from the insertion port on the right side of the buckle, the band 10 moves forward while the edge of the band 10 makes contact with the engagement pawl 31 of the operating piece 30 and presses one end of the operating piece 30 upward, and the engagement pawl 31 is removed from the engagement groove 12 (see FIG. 8C). When the band 10 is passed through further, the one end of the operating piece 30 returns to its initial position in reaction to pressure contact between the elastic member 33 and the control piece 40, and the engagement pawl 31 engages with the adjacent engagement groove 12. In this state, the engagement pawl 31 is engaged with the given engagement groove 12 to be locked, so that the band 10 can freely move forward through the buckle 20 but cannot retreat.

Figure 9A:
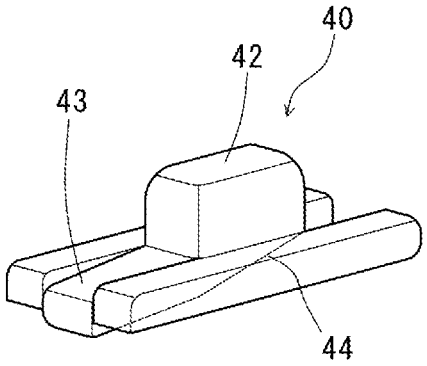
FIG. 9A is a perspective view of an operating piece in still another embodiment of the slide adjuster.
Figure 9B:
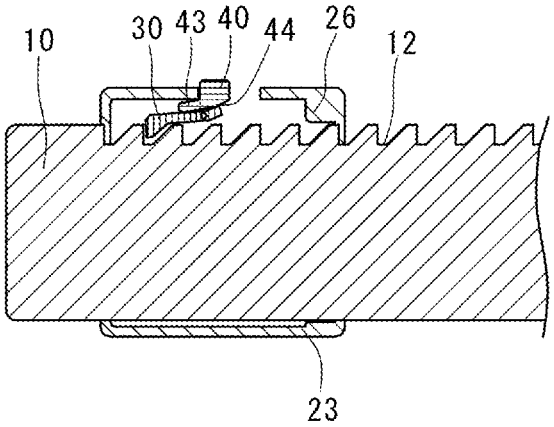
FIG. 9B is a main portion section view of the slide adjuster.

Subsequently, still another embodiment of the slide adjuster will be described with reference to FIG. 9. In the embodiment, the elastic portion 43 is provided on one end side of the control piece 40 and a recessed part 44 is formed on the bottom portion of another end side of the control piece 40, as illustrated in FIG. 9A. As illustrated in FIG. 9(2), the elastic portion 43 is brought into contact with one end side of the operating piece 30 and the other end side of the operating piece 30 is brought into contact with the recessed part 44, whereby the operating piece 30 is fixed at a given position.

According to the embodiment, with the recessed part 44 provided on the control piece 40, it is possible to incline one end of the operating piece 30 toward the side of the engagement groove 12 while arranging the control piece 40 and the operating piece 30 to be close to each other. Therefore, it is possible to further enhance engagement strength between the band 10 and the buckle 20 while downsizing the buckle 20 as a whole.

In the above-described embodiments, the engagement grooves 12 are formed along the edge of the band 10. However, the method of forming the engagement grooves 12 of the band 10 is not particularly limited in the present invention. The form of the buckle 20 is determined appropriately depending on a method of forming the engagement grooves 12.

EXPLANATION OF REFERENCE NUMERALS

10 band
12 engagement groove
11 belt
15 fastening portion
18 stopper
20 buckle
24 buckle body
26 insertion space
30 operating piece
31 engagement pawl
35 connection shaft
40 control piece
43 elastic portion
50 magnet

The invention claimed is:

1. A slide adjuster including a band and a buckle, the slide adjuster enabling an engagement pawl of the buckle to engage with saw-toothed engagement grooves formed along an edge of the band, wherein the buckle includes: (i) a buckle body that has a bottom plate and a top plate facing each other and side plates connecting the bottom plate and the top plate, an interior of the buckle body serving as an insertion space, and (ii) an operating piece provided inside the buckle body which has, on one end of the operating piece, the engagement pawl which is capable of engaging with the engagement grooves of the band, the operating piece being supported by a connection shaft connecting the bottom plate and the top plate at a midpoint such that the operating piece is pivotable around the midpoint as a fulcrum, and a control piece that controls pivot of the operating piece and is provided on the buckle body, and when the band is passed through the insertion space of the buckle while the engagement pawl is engaged with one of the engagement grooves of the band to be locked, the band moves forward while the edge of the band makes contact with the engagement pawl of the operating piece and presses the one end of the operating piece upward, and the operating piece returns to an initial state in reaction to coming into contact with the control piece, so that the band can freely approach the buckle but cannot retreat.

2. The slide adjuster according to claim 1, wherein the control piece can move in a vicinity of the operating piece, and the engagement between the band and the buckle can be released by moving the control piece.

3. The slide adjuster according to claim 1, wherein the control piece can move in the vicinity of the operating piece, and the engagement between the band the buckle can be locked by moving the control piece.

4. The slide adjuster according to claim 1, wherein the engagement grooves are formed symmetrically on edges of the band that face away from each other.

5. The slide adjuster according to claim 1, wherein a stopper is provided on a tip of the band, and a belt for extending the band is stored in the band.

6. The slide adjuster according to claim 1, wherein magnets are provided on at least a tip of the band and the bottom plate of the buckle.

7. The slide adjuster according to claim 1, wherein a fastening portion allowing the buckle and the band to be drawn close by the fingertips of one hand is provided on an outer surface of the band.

8. The slide adjuster according to claim 1, wherein metal is inserted to portions of the engagement grooves of the buckle with which the engagement pawl is brought into contact.

9. The slide adjuster according to claim 1, wherein a case storing a precision device is provided on the buckle.

* * * * *